US005087217A

United States Patent [19]

Tuan et al.

[11] Patent Number: 5,087,217

[45] Date of Patent: Feb. 11, 1992

[54] SWIMMING SHOE

[76] Inventors: C. T. Tuan; T. L. Duan, both of 4F, 64, Lane 283, Chung Cheng Rd., Yung Ho, Taipei Hsien, Taiwan

[21] Appl. No.: 580,290

[22] Filed: Sep. 11, 1990

[51] Int. Cl.[5] ..... A63B 31/12; A63B 31/11; A63B 31/00

[52] U.S. Cl. ..... 441/61; 441/60; 441/62; 441/55; 441/59; 272/71

[58] Field of Search ..... 441/60, 61, 62, 55, 441/59; 272/71, 119

[56] References Cited

U.S. PATENT DOCUMENTS 719,583 2/1903 Griffin ..... 441/60
1,480,366 9/1923 Bergerson ..... 441/60
1,673,292 6/1928 Maxwell ..... 441/60

*Primary Examiner*—Sherman Basinger
*Assistant Examiner*—Kenneth Lee
*Attorney, Agent, or Firm*—Wenderoth, Lind & Ponack

[57] ABSTRACT

A swimming shoe composed of a shoe body, several water-resisting flanges and an attached swimming-assistance device. The shoe body has the shape of a sandal which has a shoe bottom, a shoe surface, two fixing plates and a fastener. In the vamp of the shoe there are two fixing sets which both have a fixing set and a button to attach the water-resistant flange. In the shoe body, the fixing plate can hold the swimming-resisting device. This new device will not interfere with walking on land and also can be used as an aid to help the swimmer to swim faster.

3 Claims, 5 Drawing Sheets

SWIMMING SHOE

BACKGROUND OF THE INVENTION

1. Field of the Invention

The present invention relates to a swimming shoe which has water-resisting flanges on the shoe body and supporting a swimming-assistance device to enable a swimmer to remain afloat in the water and help the swimminer to swim. It is also expected that the swimmer can easily walk on land wearing the swimming shoe.

2. Description of the Prior Art

It is understood that normally the main auxiliary device used for a swimmer in the water is a flipper which is mainly designed to have the shape of a frog or duck webfoot. The flipper has an alcove to accommodate the foot of the swimmer. While swimming, the swimmer must use both legs respectively to kick the water to cause the flippers to act as a propelling means to obtain impulsion and buoyancy so that the swimmer can move anywhere he wants in the water. However, when a heavy surf arises, it is very difficult for the swimmer to control himself and he may even lose the flipper he is wearing, which is caused by the improper design of providing only one alcove to accommodate the foot of the swimmer. It is also found that it is difficult to walk on land wearing flippers. Besides, the flipper may hurt the swimmer if he tries to take it off in the water. Walking with flippers on land is time-consuming and also requires very big efforts for lifting the legs due to the fact that the material used is soft caoutchouc. Otherwise, one needs to walk backwards.

SUMMARY OF THE INVENTION

To overcome the inconvenience described above, the present invention seeks to provide a new structure to help the swimmer walk easily on land and also swim well in the water. The idea comes from the shape of a sandal having a body with water-resisting flanges and a swimming-assistance device. The arrangement ensures that the swimmer has a good walking capability on the land and also the swimmer can swim in the water very easily and very comfortably.

The main object of the present invention is to utilize the water-resisting flanges of the shoe body and also the swimming-assistance device to provide an acceleration force and increase the speed of moving forward while swimming which is much easier than the swimmer trying to swim in the water with bare feet.

Another object of the present invention is to provide such a swimming shoe that can protect the sole of the swimmer's foot against injury from shells, rocks or other piercing materials while walking in the water or on land or from burning the feet due to hot sand on a beach. Walking with the swimming shoe in the water will not be affected by water currents, nor will the swimming shoes come loose.

A further object of the present invention is to provide a light and very convenient shoe which will increase the buoyancy of the swimmer and accelerate swimming speed. Due to the structure of aligning the water-resisting flange in line with the shoe surface, it will not be burdensome for the swimmer while walking on land so that the swimming shoes can be worn either in the water or on land, both with excellent comfort.

DETAILED DESCRIPTION OF THE PREFERRED EMBODIMENTS

Figure 1:
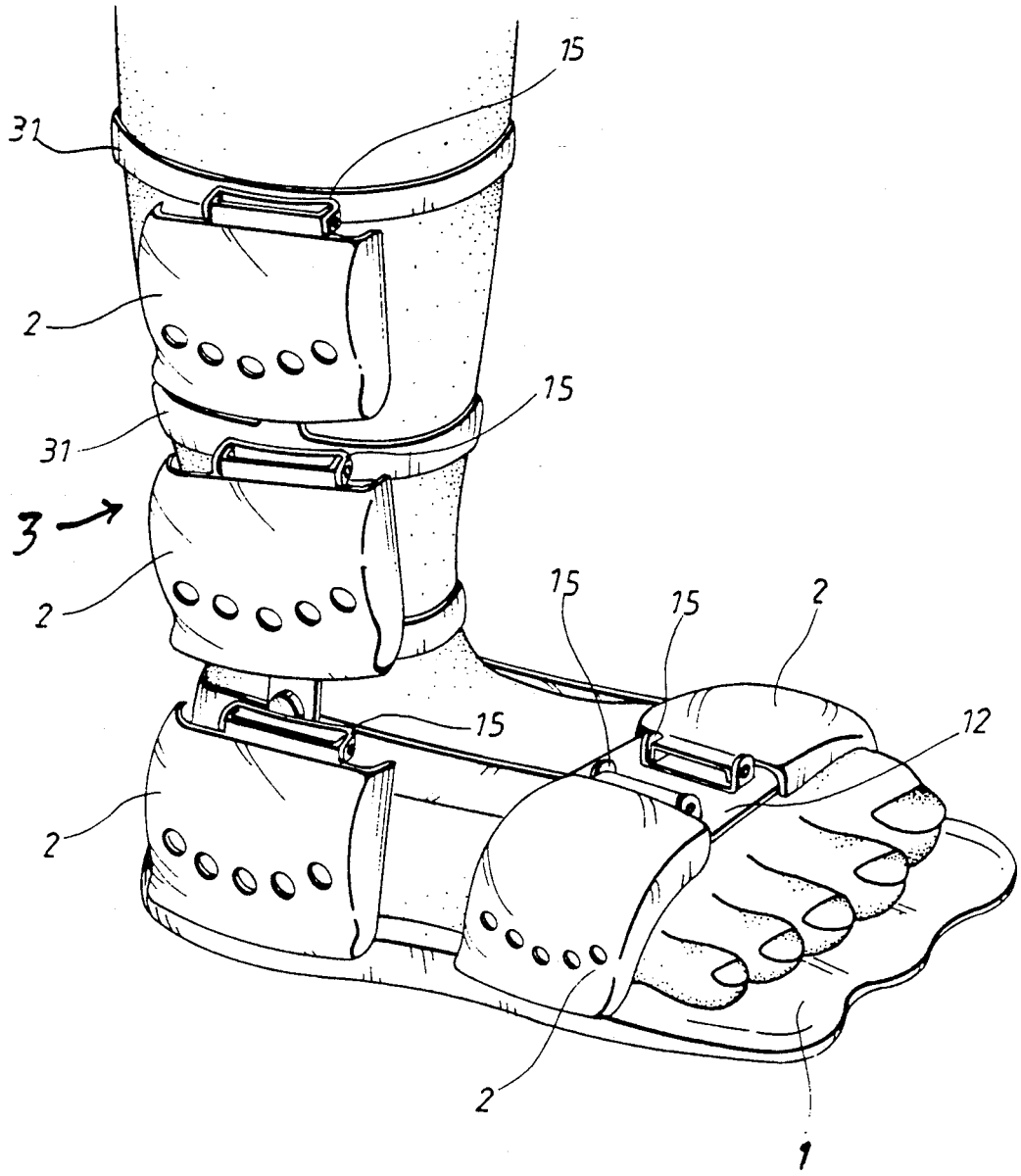
FIG. 1 is a perspective view of a swimming shoe and a swimming-assistance device according to the present invention in position on a leg and foot.
Figure 2:
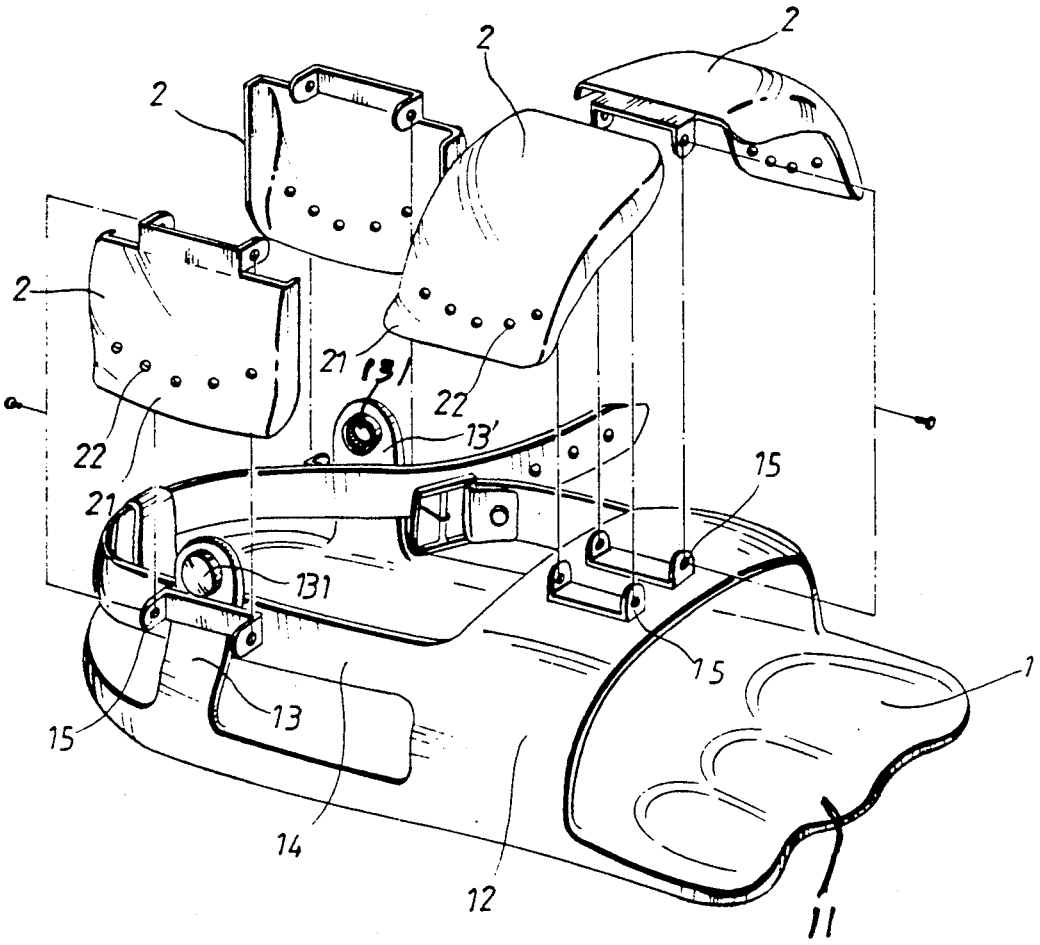
FIG. 2 is an exploded view showing the components of the swimming shoe of FIG. 1.

As shown in FIGS. 1 and 2, the swimming shoe of the invention is composed of a shoe body 1, water-resisting flanges 2 and a swimming-assistance device 3. Shoe body 1 can be made like a sandal composed of a shoe sole 11, a shoe strap 12, two fixing plates 13 and 13', and one strap-like fastener 14. Shoe strap 12 is located at the front of the shoe body and has two hinge mounts 15 thereon. Each hinge mount 15 has a resisting flange 2 hingedly mounted thereon. Two mounting plates 13 and 13' are provided on two sides of shoe body 1 near the rear. A hinge mount 15 is mounted on each mounting plate and each has a further resisting flange 2 hingedly mounted thereon. At the top of each of the fixing plates 13 and 13' is a fastener member 131, 131' to attach the swimming-assistance device. Strap-like fastener 14 is used to fasten the swimming shoe to the foot of the wearer.

Each resisting flange 2 has a curved shape, an inner hollow space and its bottom curved outward to form a water-resisting surface 21 and has many water guiding holes 22 therein.

Figure 3:
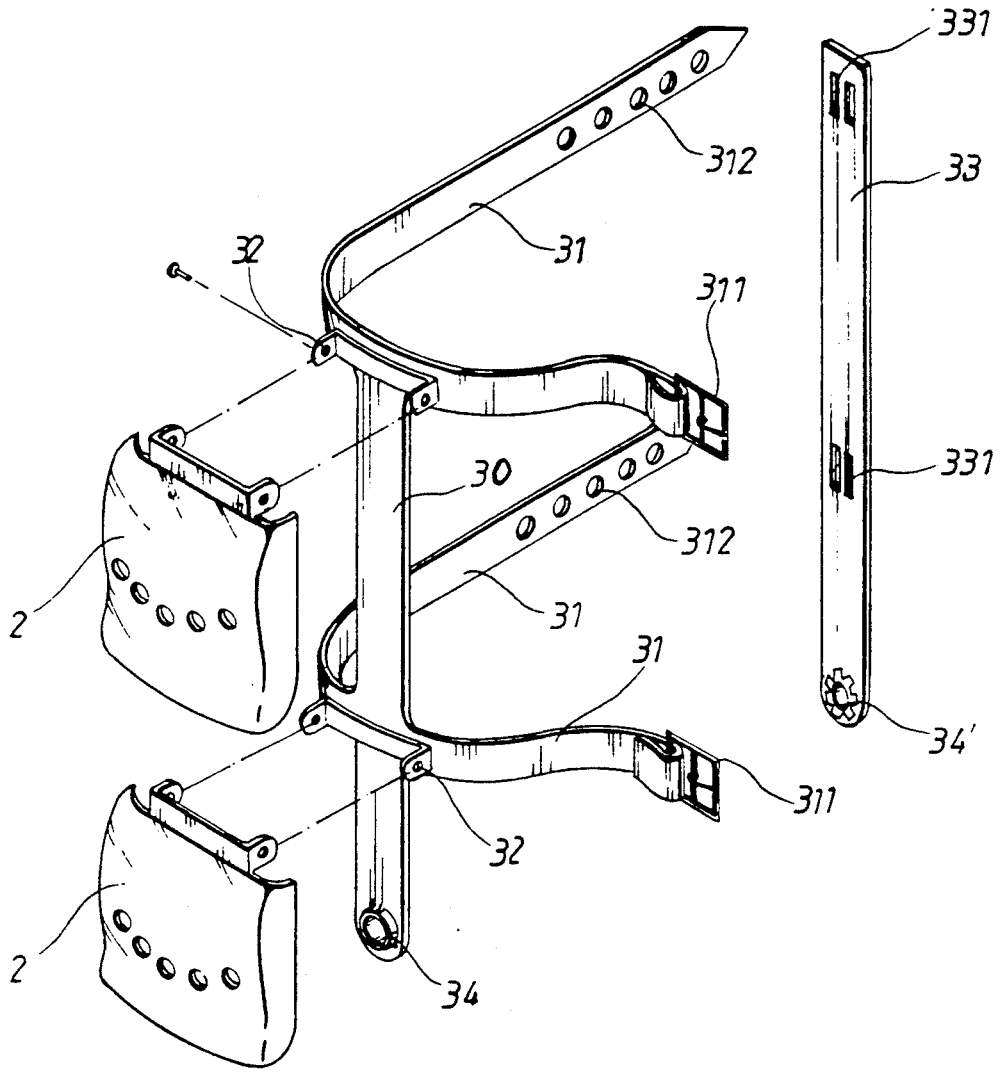
FIG. 3 is a similar view of the components of the swimming-assistance device of FIG. 1.

The swimming-assistance device 3 is composed of a vertical supporting shaft 30, a fixing bar 33 and still further water-resisting flanges 2. As indicated in FIG. 3, the supporting plate 30 has two long straps 31 extending horizontally therefrom with the buckle 311 on one end and holes 312 at the other end for connection to the buckle. At the junction of each strap 31 and the supporting plate 3, is a hinge mount 32 to which is attached a still further water-resisting flange 2. At the bottom of the supporting plate 30 is a fastener element 34 for mating with fastener element 131 on the shoe. To ensure that the supporting plate 30 can be properly securely fastened to the swimmer's leg, the fixing bar 33 can be used by passing the straps 31 through slots 331 therein and attaching the lower end to the fastener element 131' on the shoe by fastener element 34'.

All parts are made of water-proof and salt water corrosion resistant material.

As is clear from FIG. 1, the procedure for putting on the swimming shoes is to put the foot into the shoe body 1, and then fasten the strap-like fastener 14. When the swimming-assistance device is to be used, it is fixed by means of the straps 31 and then tightened to the swimmer's leg and then the fastener elements 34 and 34' are fastened to the fastener elements 131 and 131' on the shoe.

Figure 4A:
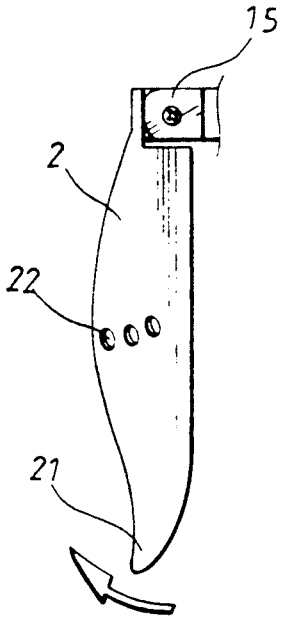
FIGS. 4*a* and 4*b* are elevation views of water-resisting flanges.
Figure 4B:
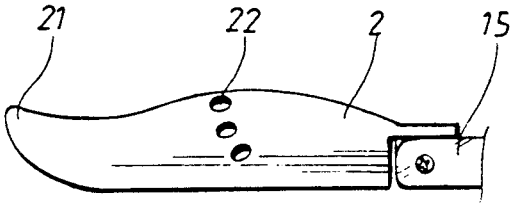
Figure 5:
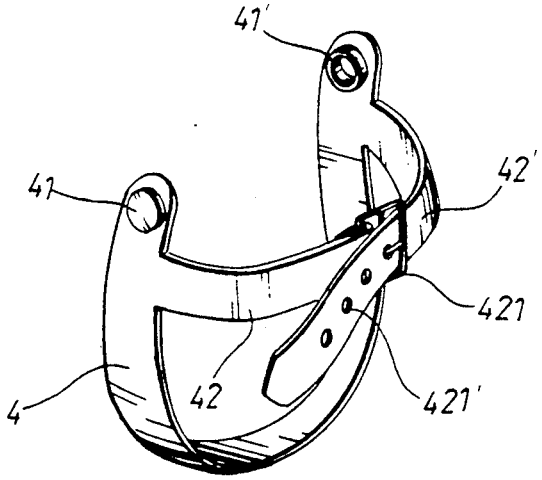
FIG. 5 is a perspective view of a fixing strap for the swimming-assistance device.

When the swimmer wears this new swimming shoe and swims in the water by moving both legs rearwardly, water will enter under water-resisting flanges 2 and the water-resisting flanges will pivot outwardly laterally of the swimming shoe (as shown in FIG. 4B) which will increase the force of resistance, and then when the legs are drawn forwardly the water will force the water-resisting flanges 2 inwardly and the water will go through the water guiding holes 22 to force out the water under the water-resisting flanges to facilitate the inward pivoting of the water-resisting flanges 2 against the shoe surface or the leg which will reduce the resistance and increase swimming speed. While walking on land, the water-resisting flanges 2 will fall naturally against the shoe surface or the leg and not affect walking so there is no need to change to conventional shoes.

Figure 6:
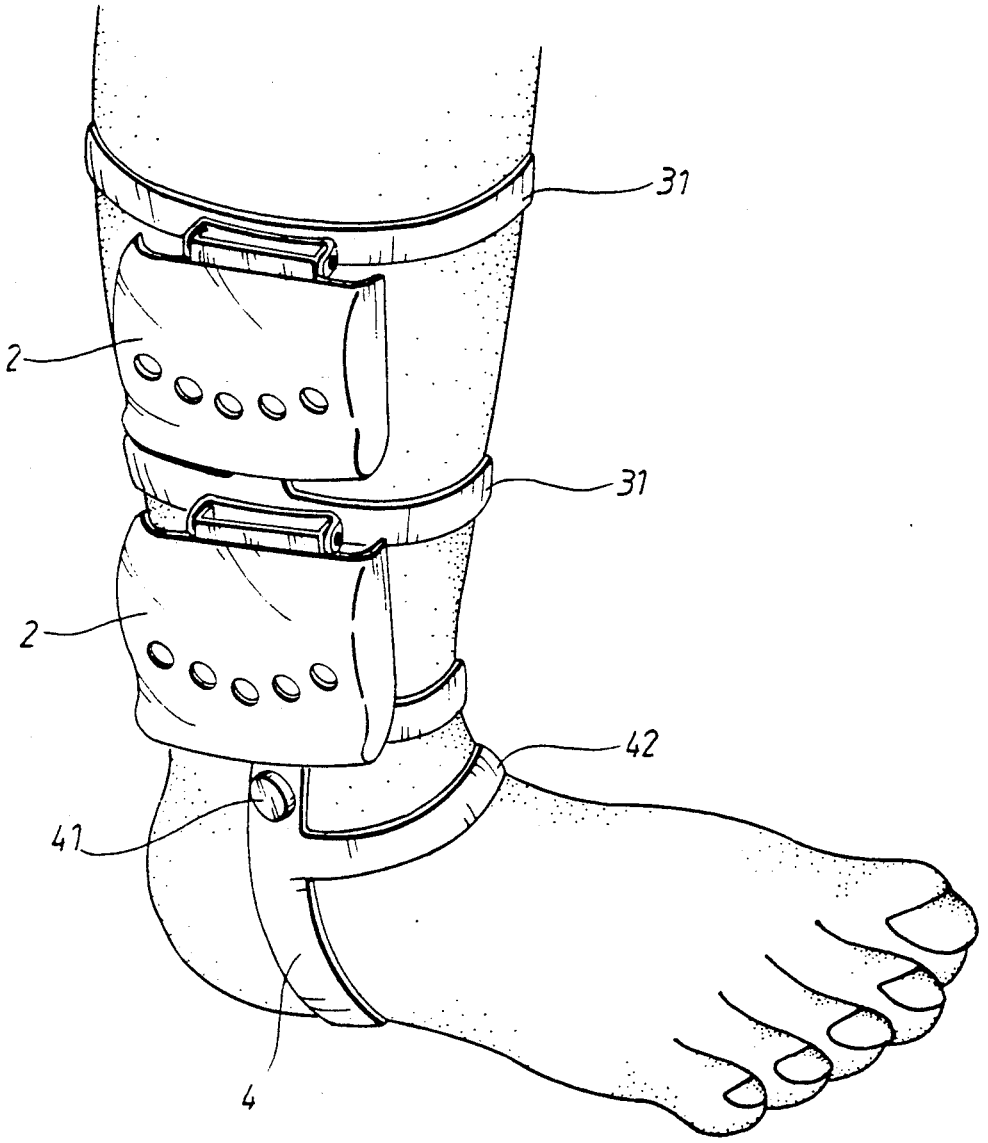
FIG. 6 is a perspective view of only the swimming-assistance device in position on a leg.

As indicated in FIG. 6, the swimming-assistance devicee can be used independently of the shoe by being attached to the swimmer's leg to help swimming speed and improve floating capability. In addition, to strengthen the attachment to the swimmer's leg, it is necessary to use a foot strap 4 which has fastener elements 41 and 41' at both ends to connect to fastener elements 34 and 34' and fastener straps 42 and 42' which have buckles 421 and holes 421' so that the straps 42 and 42' can be joined.

As described above, this invention has a compact structure which can be used not only in the water to save energy and improve swimming capability, but which also provides a comfortable feeling while walking on land.

We claim:

1. A swimming shoe comprising:

a sole;

a sandal strap extending across the front portion of said sole;

a strap-like fastener extending around a rear portion of said sole from said sandal strap;

a fixing plate extending upwardly from the edge of the rear portion of said sole on each side of said sole and having a hinge mount on the upper end thereof and a fastener member on the upper end thereof;

a water resisting flange pivotally mounted on each hinge mount for free swinging movement from a position against the fixing plate to a position laterally outwardly of said shoe; and said sandal strap having a pair of hinge mounts on the upper portion thereof and a further water resisting flange pivotally mounted on each hinge mount for free swinging movement from a position against the sandal strap to a position laterally outwardly of said shoe;

all of said water resisting flanges having a free end which, when the flanges are against said fixing plates and said sandal strap, terminate short of the bottom of said sole, whereby when the sole of the shoe is on the ground, the free ends of the flanges do not touch the ground and the wearer can walk in the swimming shoe in the same manner as in an ordinary sandal.

2. A swimming shoe as claimed in claim 1 further comprising a swimming assistance device having a vertical supporting plate having a further fastener member on the lower end thereof detachably connected to the fastening member on the upper end of said fixing plate on the outside of said swimming shoe, a plurality of leg engaging straps projecting laterally from points on said vertical supporting plate at different heights above the lower end of said vertical supporting plate, a fixing bar extending between said straps on the opposite side of the wearer's leg from said vertical supporting plate and to which said straps are attached and having a further fastener member on the lower end thereof detachably connected to the fastening member on the upper end of said fixing plate on the inside of said swimming shoe, further hinge mounts at spaced vertical positions along said vertical supporting plate, and still further water resisting flanges pivotally mounted on said further hinge mounts for pivoting movement from a position against said vertical supporting plate to a position extending laterally of said vertical supporting plate.

3. A swimming assistance device comprising a vertical supporting plate having a fastener member on the lower end thereof, a plurality of leg engaging straps projecting laterally from points on said vertical supporting plate at different heights above the lower end of said vertical supporting plate, a fixing bar extending between said straps on the opposite side of the wearer's leg from said vertical supporting plate and to which said straps are attached and having a further fastener member on the lower end thereof, hinge mounts at spaced vertical positions along said vertical supporting plate, water resisting flanges pivotally mounted on said hinge mounts for pivoting movement from a position against said vertical supporting plate to a position extending laterally of said vertical supporting plate, a foot strap adapted to extend under the foot of a wearer and having fastener members on the ends thereof detachably attached to the fastener members on the lower ends of said vertical supporting plate and said fixing bar, and a front ankle strap extending forwardly from the upper part of said foot strap and adapted to extend around the front of an ankle of a wearer.

* * * * *